US008230912B1

(12) United States Patent
Connell

(10) Patent No.: US 8,230,912 B1
(45) Date of Patent: Jul. 31, 2012

(54) HYDRAULIC BIDIRECTIONAL JAR

(75) Inventor: Michael L. Connell, Mustang, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 269 days.

(21) Appl. No.: 12/830,702

(22) Filed: Jul. 6, 2010

Related U.S. Application Data

(60) Provisional application No. 61/261,098, filed on Nov. 13, 2009.

(51) Int. Cl.
*E21B 4/14* (2006.01)

(52) U.S. Cl. ..... 166/178; 175/296; 175/297

(58) Field of Classification Search ..... 166/301, 166/178; 175/296, 297
See application file for complete search history.

(56) References Cited

U.S. PATENT DOCUMENTS

| | | | | | |
|---|---|---|---|---|---|
| 3,062,305 | A | * | 11/1962 | Sutliff | 175/297 |
| 3,757,816 | A | | 9/1973 | Price | |
| 3,853,187 | A | * | 12/1974 | Sutliff et al. | 175/297 |
| 3,877,530 | A | | 4/1975 | Dowmen | |
| 3,955,634 | A | | 5/1976 | Slator et al. | |
| 3,974,876 | A | | 8/1976 | Taylor | |
| 3,987,858 | A | | 10/1976 | Slator et al. | |
| 4,036,297 | A | | 7/1977 | Swihart, Sr. | |
| 4,111,271 | A | | 9/1978 | Perkins | |
| 4,179,002 | A | | 12/1979 | Young | |
| 4,181,186 | A | | 1/1980 | Blanton | |
| 4,186,807 | A | | 2/1980 | Sutliff et al. | |
| 4,196,782 | A | | 4/1980 | Blanton | |
| 4,211,293 | A | | 7/1980 | Blanton | |
| 4,361,195 | A | | 11/1982 | Evans | |
| 4,456,081 | A | | 6/1984 | Newman | |
| 4,462,471 | A | | 7/1984 | Hipp | |
| 4,524,838 | A | | 6/1985 | Sutliff | |
| 4,607,692 | A | | 8/1986 | Zwart | |
| 4,865,125 | A | * | 9/1989 | De Cuir | 166/178 |
| 4,958,691 | A | | 9/1990 | Hipp | |
| 4,979,577 | A | | 12/1990 | Walter | |
| 5,007,479 | A | | 4/1991 | Pleasants et al. | |
| 5,012,871 | A | | 5/1991 | Pleasants et al. | |
| 5,033,557 | A | | 7/1991 | Askew | |
| 5,086,853 | A | | 2/1992 | Evans | |
| 5,094,303 | A | | 3/1992 | Jenne | |
| 5,117,922 | A | | 6/1992 | Baron | |
| 5,123,493 | A | | 6/1992 | Wenzel | |
| 5,139,086 | A | | 8/1992 | Griffith, Sr. | |

(Continued)

OTHER PUBLICATIONS

Bowen Tools Division, IRI International Corporation, "Bowen Hydraulic Up/Down Coiled Tubing Jar," Instruction Manual (24 pages), 1998, Bowen Tools Division, IRI International Corporation, Houston, Texas, USA.

*Primary Examiner* — William P Neuder
(74) *Attorney, Agent, or Firm* — Mary M. Lee

(57) ABSTRACT

A bidirectional jarring tool that allows repetitive firing in one direction without firing the tool in the opposite direction. One of the tubular members provides up and down anvil surfaces, and the other member provides up and down hammer surfaces. Inner and outer tubular members define a hydraulic chamber with a restricted section that divides the chamber into an upper section and a lower section. Upper and lower pistons, each with a valved flow channel, reciprocate through the restricted section to produce up and down jarring impacts. When the restricted section is disposed between the upper and lower pistons, the tool is in a neutral position and can be jarred repetitively in either direction.

16 Claims, 8 Drawing Sheets

U.S. PATENT DOCUMENTS 5,156,223 A 10/1992 Hipp
5,174,393 A 12/1992 Roberts et al.
5,211,241 A 5/1993 Mashaw, Jr. et al.
5,226,487 A 7/1993 Spektor
5,318,139 A 6/1994 Evans
5,327,982 A 7/1994 Trahan et al.
5,330,018 A 7/1994 Griffith
5,411,107 A 5/1995 Hailey et al.
5,413,185 A 5/1995 Kayes
5,447,196 A 9/1995 Roberts
5,495,902 A 3/1996 Hailey et al.
5,503,228 A 4/1996 Anderson
5,584,353 A 12/1996 Chancey et al.
5,595,244 A 1/1997 Roberts
5,595,253 A 1/1997 Martin et al.
5,603,383 A 2/1997 Wentworth et al.
5,624,001 A 4/1997 Evans
5,647,446 A 7/1997 Wenzel
5,794,718 A 8/1998 Zollinger et al.
5,803,182 A 9/1998 Bakke
5,906,239 A 5/1999 Oettli
5,918,688 A 7/1999 Evans
5,918,689 A 7/1999 Roberts
5,931,242 A 8/1999 Oettli
5,968,312 A 10/1999 Sephton
5,984,028 A * 11/1999 Wilson ..... 175/297
6,035,954 A 3/2000 Hipp
6,047,778 A 4/2000 Coffman et al.
6,050,346 A 4/2000 Hipp
6,050,347 A 4/2000 Jenne
6,053,261 A 4/2000 Walter
6,062,324 A 5/2000 Hipp
6,152,222 A 11/2000 Kyllingstad
6,164,393 A 12/2000 Bakke
6,202,767 B1 3/2001 Friis
6,263,986 B1 7/2001 Massner et al.
6,269,889 B1 8/2001 Wentworth
6,290,004 B1 * 9/2001 Evans ..... 175/296
6,315,063 B1 11/2001 Martini
6,439,318 B1 8/2002 Eddison et al.
6,474,421 B1 11/2002 Stoesz
6,675,909 B1 1/2004 Cowart et al.
6,712,134 B2 3/2004 Stoesz
6,725,932 B2 4/2004 Taylor et al.
6,948,560 B2 9/2005 Marsh
7,066,251 B2 6/2006 Streater et al.
7,163,058 B2 1/2007 Bakke
7,293,614 B2 11/2007 Rose
7,347,287 B2 3/2008 Chancey
7,814,995 B2 10/2010 Clausen et al.
2003/0209349 A1 11/2003 Taylor et al.
2008/0236894 A1 10/2008 Clausen et al.

* cited by examiner

HYDRAULIC BIDIRECTIONAL JAR

CROSS-REFERENCE TO RELATED APPLICATIONS

This application claims the benefit of U.S. provisional application No. 61/261,098 entitled "Jarring Tool," filed Nov. 13, 2009, the contents of which are incorporated herein by reference.

FIELD OF THE INVENTION

The present invention relates generally to downhole tools and more particularly, but without limitation, to tools used to deliver jarring impacts downhole.

DETAILED DESCRIPTION OF THE PREFERRED EMBODIMENT(S)

The jarring tool of the present invention offers an improvement in downhole hydraulic jars. This jar is bi-directional, that is, it can jar up and down in the same trip. This jar may have a neutral position so that the jar can be operated repeatedly in one direction without having to jar in the other direction. This jar can also be constructed of tubular members that can transmit torque, so that it can work with a motor or other rotary tool. The tool of the present invention provides some or all these advantages while at the time having a simple design with relatively few moving parts that can be redressed easily.

Figure 1A:
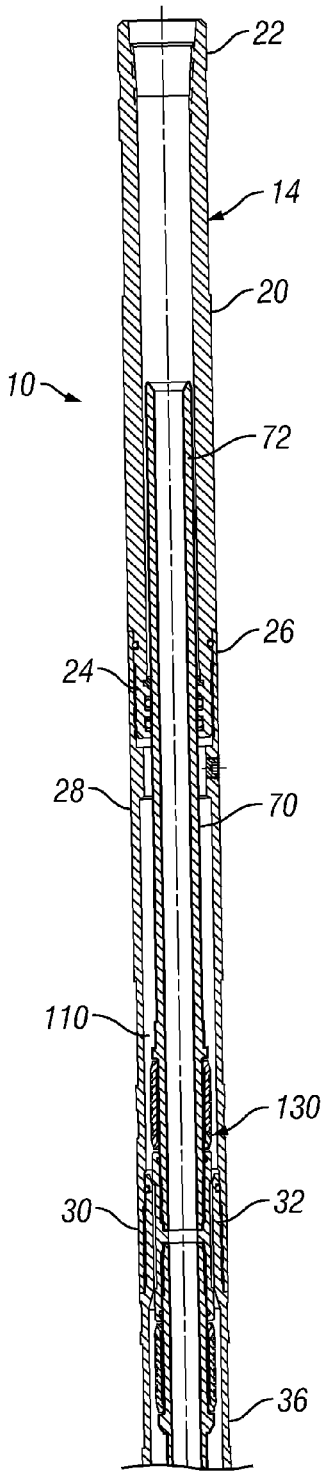
FIGS. 1A-C show a longitudinal sectional view in three segments of a jarring tool made in accordance with a preferred embodiment of the present invention.
Figure 1B:
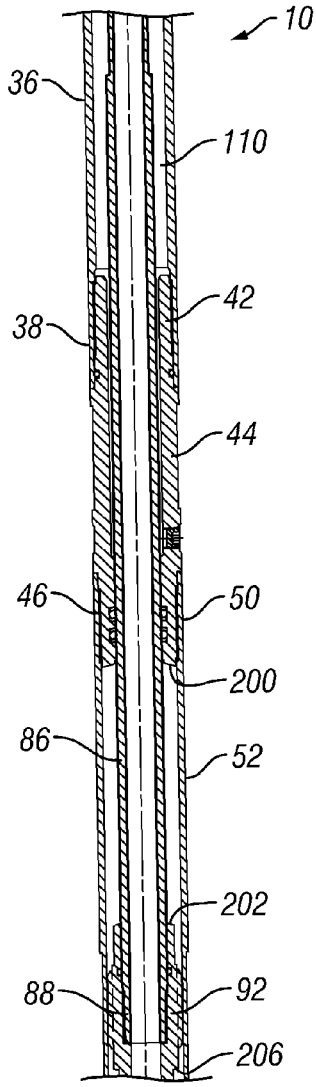
Figure 1C:
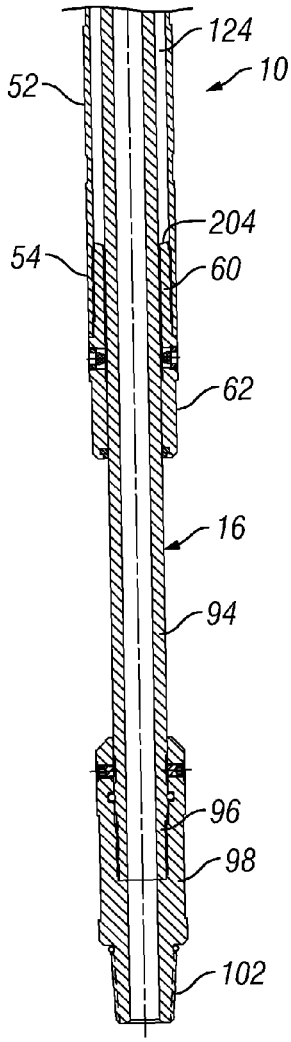

Turning now to the drawings in general to and FIGS. 1A-C, there is shown therein a jarring tool made in accordance with a preferred embodiment of the present invention and designated generally by the reference numeral 10. The jarring tool 10 is attachable to a well conduit 12 (FIG. 13), such as coil tubing, for delivering an impact downhole.

In its preferred form, the jarring tool 10 generally comprises an outer tubular assembly 14 and an inner tubular assembly 16. The inner tubular assembly 16 is telescopically received inside the outer tubular assembly 14. One of the tubular assemblies 14 and 16 is connectable to well conduit 12. The other is attachable to the downhole object.

Figure 13:
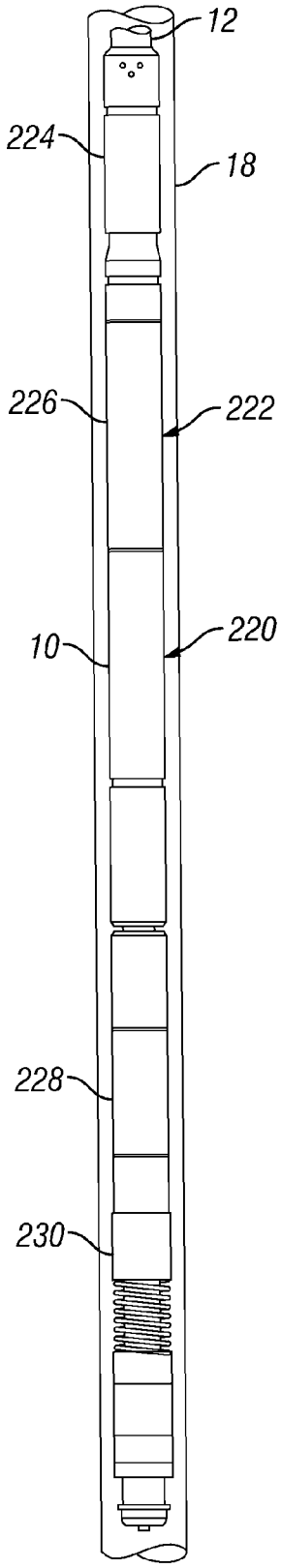
FIG. 13 shows a tool string with a bottom hole assembly ("BHA") that includes a jarring tool in accordance with the present invention.

In some instances, the tool 10 is connectable directly to a stuck object in the well 18 (FIG. 13). In other instances, the tool 10 is connected as one member of a bottom hole assembly. Thus, when the tool 10 is described as being connectable to a "stationary object downhole," it is intended to mean that the tool is connectable another tool in the tool string, which may have become lodged in the well 18, or to a fishing tool that is in turn attachable to a stuck object in the well, or even directly to a stuck object.

In the embodiment shown, the inner tubular assembly 14 comprises a lower or downhole end that connects to another tool or to a stationary object downhole, and the outer assembly 14 has an upper end that attaches to the coil tubing or other well conduit 12. In this way, the outer assembly 14 is moved up or down relative to the inner assembly 16. However, it will be appreciated that this arrangement may be reversed, that is, the outer assembly may be attachable to the downhole object (or other tool) and the inner assembly attachable to the well conduit.

As used herein, the terms "up," "upward," "upper," and "uphole" and similar terms refer only generally to the end of the drill string nearest the surface. Similarly, "down," "downward," "lower," and "downhole" refer only generally to the end of the drill string furthest from the well head. These terms are not limited to strictly vertical dimensions. Indeed, many applications for the tool of the present invention include non-vertical well applications.

Throughout this specification, the outer and inner tubular assemblies 14 and 16 and the jarring assembly components are described as moving "relative" to one another. This is intended to mean that either component may be stationary while the other is moved. Similarly, where a component is referred to as moving "relatively" downwardly or upwardly, it includes that component moving downwardly as well as the other, cooperative component moving upwardly.

Both the outer tubular assembly 14 and inner tubular assembly 16 preferably are composed of several interconnected tubular members. As shown in FIGS. 1A-C, the outer tubular assembly 14 may comprises a first member such as the top sub 20 having an upper end 22 connectable to coil tubing or other well conduit 12 (FIG. 13). The lower end 24 of the top sub 20 connects to a second member such as the upper end 26 of an upper housing 28.

The lower end 30 of the upper housing 28 connects to a third member such as the upper end 32 of a piston housing 36. The lower end 38 of the piston housing 36 connects to a fourth member such as the upper end 42 of an oil port sub 44. The lower end 46 of the oil port sub 44 connects to a fifth member such as the upper end 50 of a lower housing 52. The lower end 54 of the lower housing 52 connects to a sixth member such as the upper end 60 of a wiper seal sub 62, which forms the lowermost end of the outer tubular assembly 14.

The top sub 20, the upper housing 28, the piston housing 36, the oil port sub 44, the lower housing 52, and the wiper seal sub 62, all are interconnected for fixed movement with the coil tubing or other well conduit 12. The number and configuration of these tubular members may vary. Preferably all these members are interconnected by conventional threaded joints, but other suitable connections may be utilized.

With continued reference to FIGS. 1A-C, the preferred inner tubular assembly 16 comprises an upper mandrel 70 with an upper end 72 telescopically received in the top sub 20 of the outer tubular assembly 14. Connected to the lower end 74 of the upper mandrel 70 is the upper end 78 of a coupler mandrel 80. The lower end 82 of the coupler mandrel 80 is attached to the upper end 84 of a center mandrel 86. The lower end 88 of the center mandrel 86 is attached to the upper end 92 of a lower mandrel 94, the lower end 96 of which is attached to a bottom sub 98. A set screw 100 may be provided to secure the joint between the lower mandrel 94 and the bottom sub 98.

The lower end 102 of the bottom sub 98 is connectable, such as by threads, to another tool (FIG. 13) that may be attached to an object fixed in the well.

The upper mandrel 70, the coupler mandrel 80, the center mandrel 86, the lower mandrel 94, and the bottom sub 98 all are connected together for fixed movement with the object in the well. Thus, axial movement of the coil tubing 12, or other well conduit, causes the outer assembly 14 to move relative to the inner assembly 16. The number and configuration of these tubular members may vary. Preferably all these members are interconnected by conventional threaded joints, but other suitable connections may be utilized.

Figure 3:
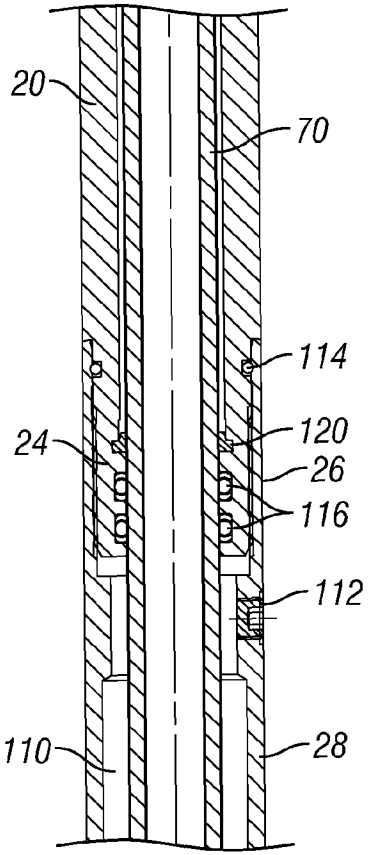
FIGS. 2-11 show enlarged, sequentially fragmented, longitudinal sectional views of the jarring tool shown in FIG. 1 in the neutral position.
Figure 2:
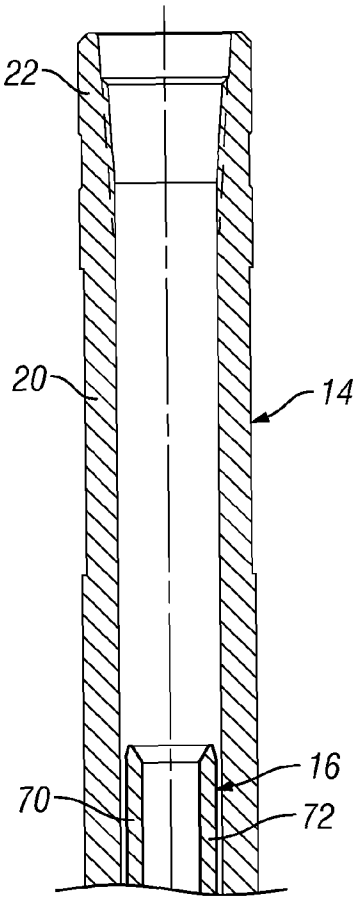
Figure 5:
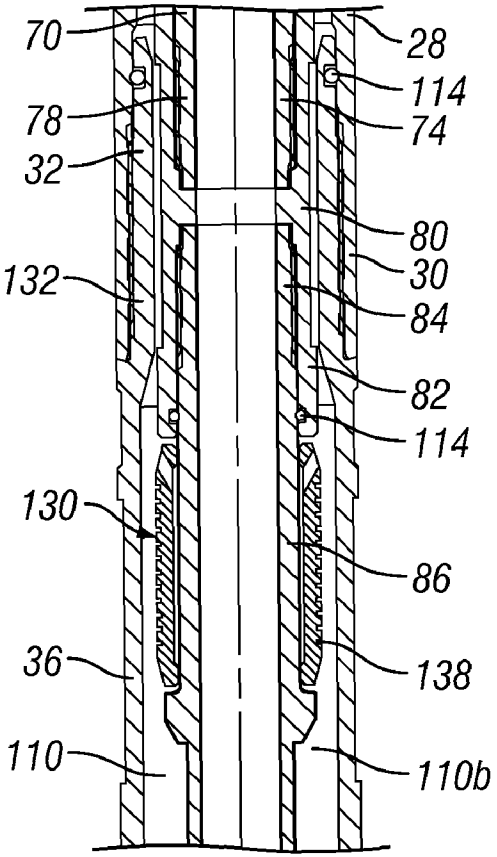
Figure 4:
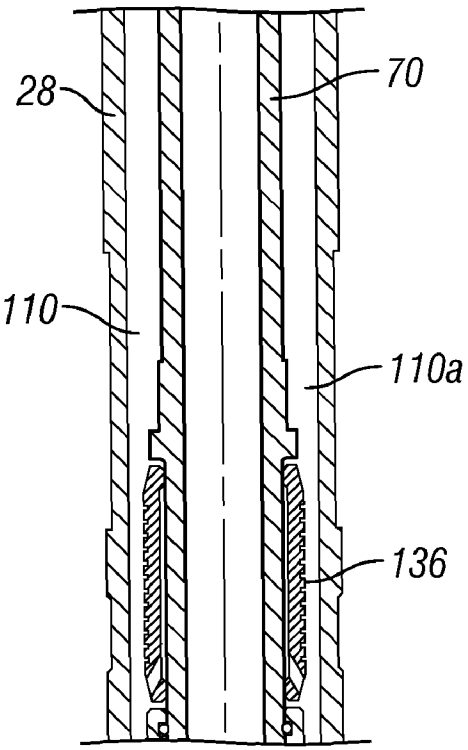
Figure 7:
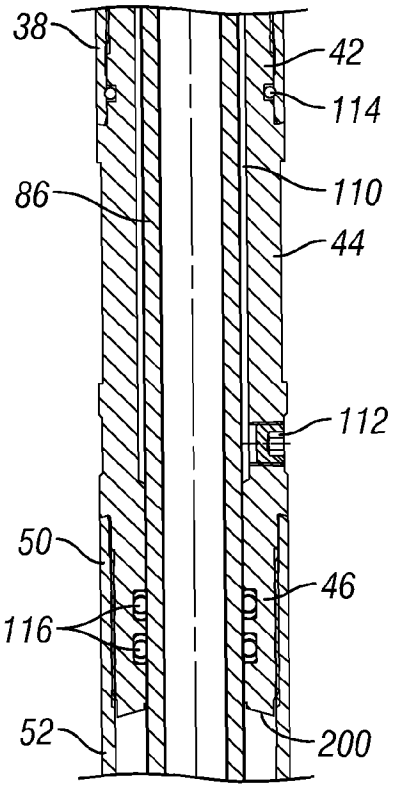
Figure 6:
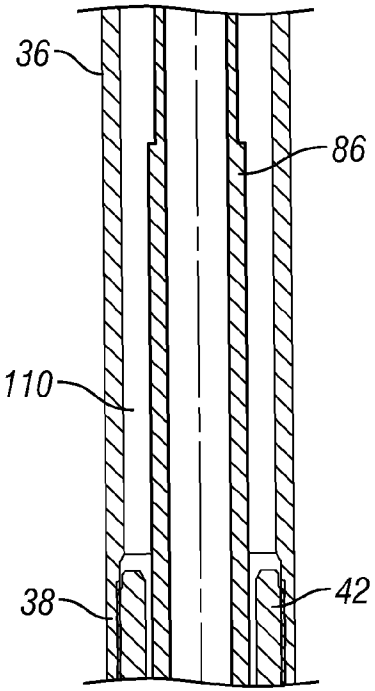

The outer diameter of the inner tubular assembly 16 and the inner diameter of the outer tubular assembly 14 are configured to provide an annular hydraulic chamber 110 therebetween for the jarring mechanism yet to be described. This hydraulic chamber 110 extends from the lower end 24 of the top sub 20 (FIG. 3) to near the lower end 46 of the oil port sub 44 (FIG. 7). Ports with pipe plugs, collectively at 112 (FIGS. 3&7), may be provided at the upper end 24 of the upper housing 26 and at the lower end 46 of the oil port sub 44.

To make the tool fluid tight, seals such as O-rings, designated collectively by the reference numeral 114, may be used to provide a seal between threaded members. Additionally, seals, such as double O-rings with upper and lower backup rings, designated generally at 116, may be provided at the interface between the lower end 24 of the top sub 20 and the outer surface of the upper end 72 of the upper mandrel 70, and between the lower end 46 of the oil port sub 44 and outer surface of the center mandrel 86 for sealing the ends of the fluid chamber 110. Other seals, such as lip seals, my be used in lieu of or in addition to the O-ring seals. Wiper seals 120 (FIG. 3) and 122 (FIG. 10) may be included. The types of seals shown and described herein may be varied in type, number, and position.

Figure 9:
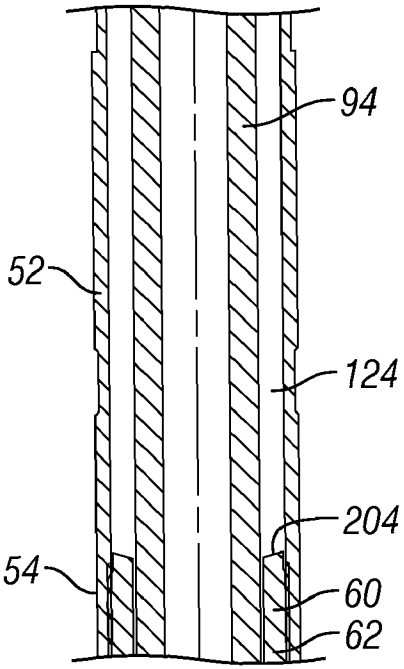
Figure 11:
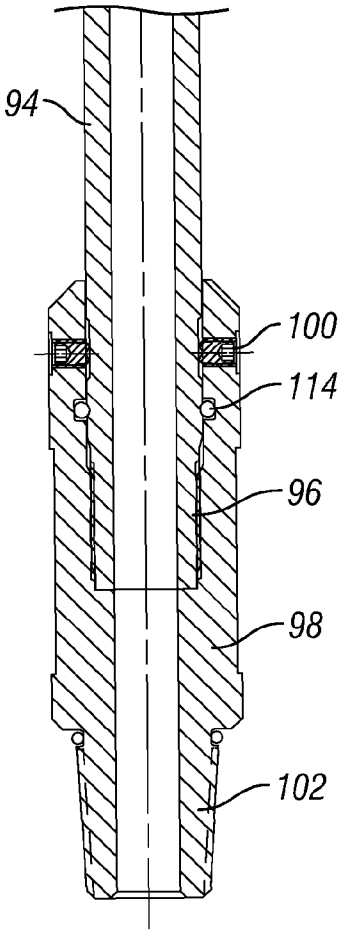
Figure 10:
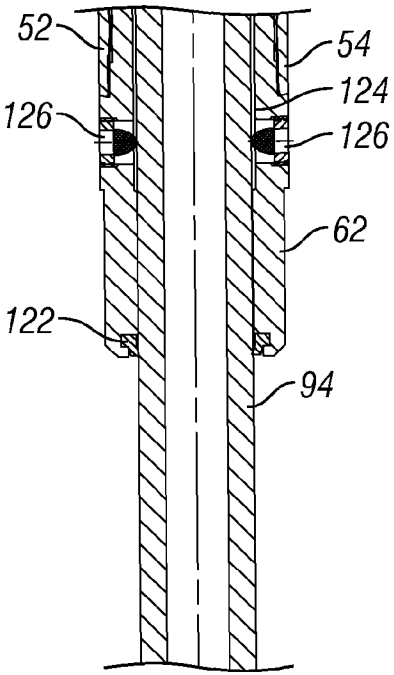

As seen in FIGS. 9-11, there is an elongate annular space 124 formed between the outer and inner tubular assemblies 114 and 116 to allow for the telescopic movement. This pressure equalization chamber 124 may be ported to the well 18 (FIG. 13) so that well fluids can fill the chamber and balance the pressure in the hydraulic fluid chamber 110. These ports 126, the number and position of which may vary, may be screened to prevent entry of particulate matter. For example, boss mount screens may be provided in the ports 126.

The tool 10 further comprises a jarring assembly 130 disposed inside the hydraulic chamber 110. The jarring assembly 130 is seen best in FIG. 12, to which attention now is directed. The jarring assembly 130 comprises a restricted section 132 positioned within the hydraulic chamber 110, and preferably on the inner wall of the outer assembly 14 that forms the outer wall of the hydraulic chamber. More specifically, the restricted section 132 in this embodiment is provided by a reduced diameter section on the inner surface of the upper end 32 of the piston housing 36.

Figure 12:
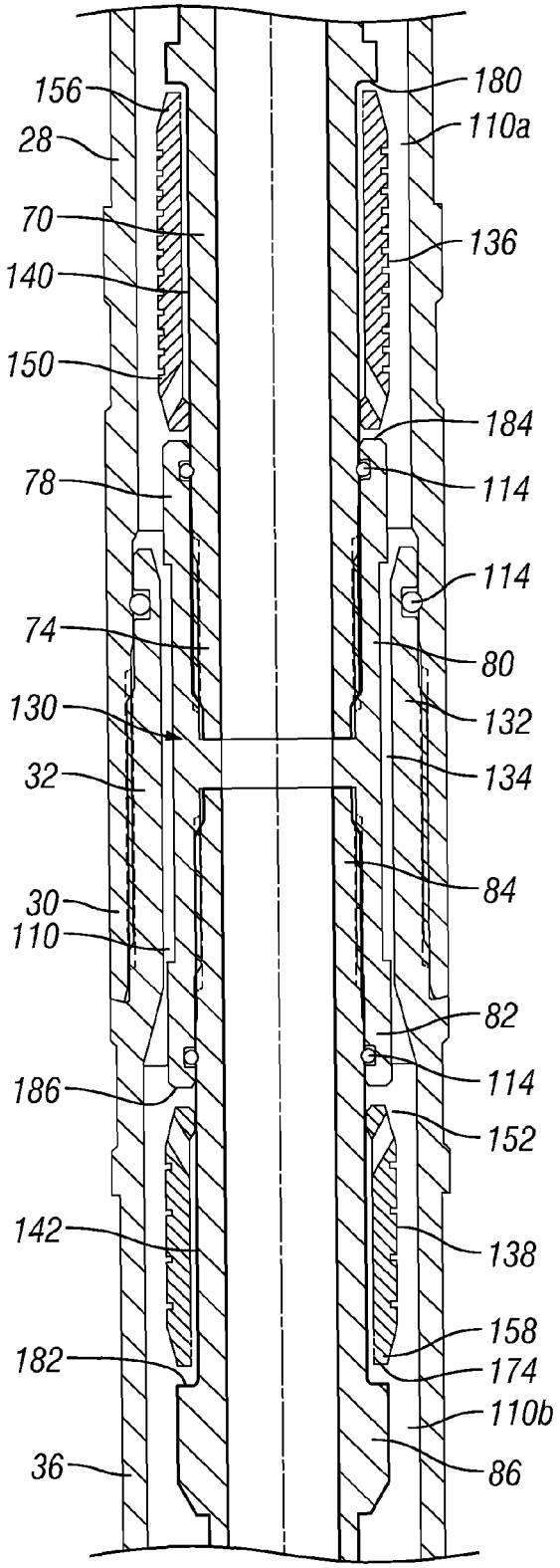
FIG. 12 shows an enlarged longitudinal sectional view of the dual piston jarring assembly in the neutral position.

In the neutral position, seen in FIG. 12, the outer surface of the coupler mandrel 80 and the inner surface of the reduced diameter section or restricted section 132 form a narrow fluid flow passage 134 generally dividing the hydraulic chamber 110 into an upper chamber **110*a* and a lower chamber 110*b*** and permitting fluid to flow therebetween.

The jarring assembly 130 further comprises first and second (upper and lower) pistons 136 and 138. The upper piston 136 "floats" or rides on the outer wall of the inner tubular assembly 16 that forms the inner wall of the hydraulic chamber 110. More specifically, the piston 136 rides on the upper mandrel 70. Similarly, the lower or second piston 138 floats "floats" or rides on the outer wall of the inner tubular assembly 16 that forms the inner wall of the hydraulic chamber 110 and, more specifically, on the central mandrel 86.

Now it will be appreciated that the first piston 136 is supported in the hydraulic chamber 110 for relative movement from a neutral position in the upper chamber **110*a* above the restricted section 132 to an up jar position below the restricted section in the lower chamber 110*b*. Similarly, the second piston 138 is supported in the hydraulic chamber 110 for relative movement from a neutral position in the lower chamber 110*b* below the restricted section 132 to a down jar position above the restricted section in the upper chamber 110*a***.

Figure 14:
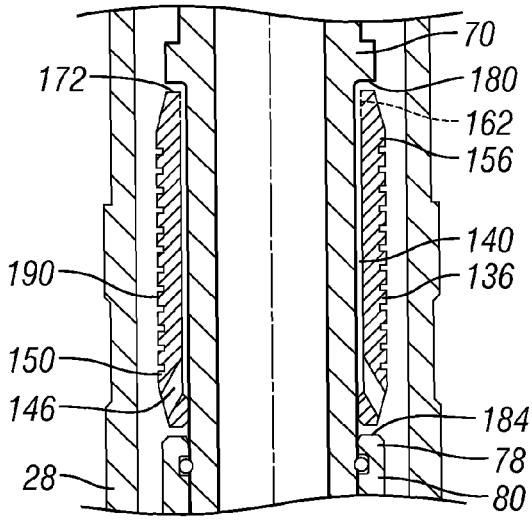
FIG. 14 is an enlarged fragmented sectional view of the upper piston of the jarring assembly.
Figure 15:
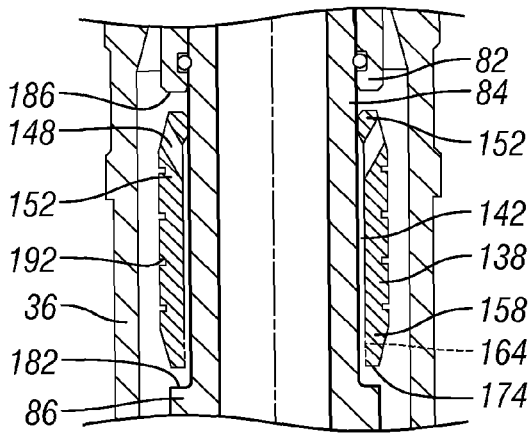
FIG. 15 is an enlarged fragmented sectional view of the lower piston of the jarring assembly.

Preferably, the pistons 136 and 138 may have flow channels that allow a secondary flow path for hydraulic fluid as the pistons pass through the restricted section 132 for a reason that will become apparent. As best seen in FIGS. 14 and 15, these channels 140 and 142 may take the form of cylindrical recesses on the inner wall of the pistons. The flow channels 140 and 142 are continuous with the hydraulic chamber 110. To that end, the piston 136 and 138 have bypass ports 146 and 148, respectively, in the opposing ends 150 and 152 of the pistons 136 and 138; these are the ends that approach the restricted section 132 in the neutral position shown in FIG. 12.

The ends 156 and 158 of the pistons 136 and 138 farthest from the restricted section 132 (in the neutral position shown in FIG. 13) may be provided with ports designated generally at 162 and 164 to allow the fluid to pass out the annular end faces 172 and 174 of the pistons 136 and 138. The number, shape and position of these flow ports may vary. In the example, shown, these flow channels take the form of four longitudinal grooves arranged equidistantly around the inner circumference of the piston. Now it will be seen that the flow path through the pistons 136 and 138—through the ports 162 and 164, the channels 140 and 142, and the bypass ports 146 and 148, is continuous with the hydraulic chamber 110.

Referring still to FIG. 12 and also to FIGS. 14 and 15, the jarring assembly 130 includes first and second valves. In the preferred embodiment, the first and second valves comprises first and second annular faces 180 and 182 formed by wider diameter segments on the upper and central mandrels 70 and 86, respectively. The first and second annular faces 180 and 182 are positioned near the ends 156 and 158, respectively, of the pistons 136 and 138. Third and fourth annular faces 184 and 186 on the upper and lower ends 78 and 82 of the coupler mandrel 80 oppose the ends 148 and 150 of the pistons.

The distance between the first and second annular faces 180 and 182 and the third and fourth annular faces 184 and 186 is greater than the length of the pistons 136 and 138, respectively. This allows the pistons to move axially between the faces 180 and 182 and the faces 184 and 186. The outer circumference of the ends 150 and 152 and 156 and 158 may be tapered to ease the pistons movement through the restricted section 132 in both directions.

The outer diameter of the pistons 136 and 138 and the inner diameter of the restricted section 132 are selected to create resistance as the pistons pass through the restricted section. Now the function of the faces 180 and 182 will become apparent. As the restricted section is pulled upwardly over the upper piston 136, the piston is pushed up against the face 180, which obstructs the ports 162. This obstruction of the flow channel 140 creates high resistance as the piston passes downward through the restricted section 132. Once the restricted section clears the end 156 of the piston 136, the resistance drops and full flow resumes, resulting in an upward jar.

Conversely, as the restricted section is pushed downward over the upper piston 138, the piston is pushed down against the face 182, which obstructs the ports 164. This obstruction of the flow channel 142 creates high resistance as the piston passes upward through the restricted section 132. Once the restricted section 132 clears the end 158 of the piston 138, the resistance drops and full flow resumes, resulting in a downward jar.

Thus, the valve faces 180 and 182 are configured to close the flow channels 140 and 142 as the pistons 136 and 138 move in a down and up direction, respectively, through the restricted section 132, and to open the flow channels as the upper and lower pistons move in an up and down direction, respectively. The abutting surfaces—the shoulders 180 and 182 and the end faces 172 and 174—may be finely polished to provide a metal-to-metal seal that prevents the loss of lubricant therethrough.

The outer walls of the pistons 136 and 138 may have one and preferably a plurality of circumferential grooves designated generally at 190 and 192 to retain hydraulic fluid. In this way, the fluid-filled grooves act like piston rings as the pistons are pushed or pulled through the restricted section, avoid metal-to-metal contact and wear at this interface.

Figure 8:
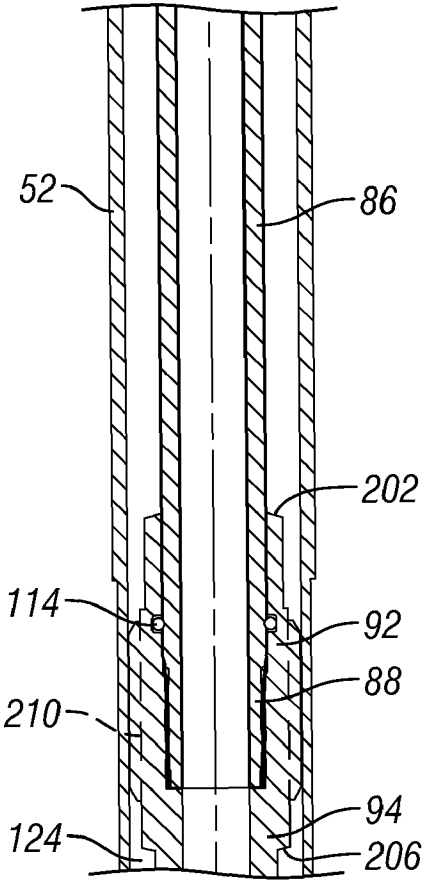

As shown in FIGS. 7 and 8, the lower end face of the oil port sub 44 forms a down hammer surface 200 that impacts the down anvil surface 202 on the upper end face of the upper end 92 of the lower mandrel. As shown in FIGS. 8 and 9, the upper end face on the upper end 60 of the wiper seal sub 62 forms an up hammer surface 204 that impacts the up anvil surface 206 formed on the lower mandrel 94 a distance below the upper end face 202. Thus, a downward jarring force is created when the down hammer surface 200 impacts the down anvil surface 202, and an upward jarring force is created when the up hammer surface 204 impacts the up anvil surface 206.

To permit transmission of torque through the tool 10, the tool may include some anti-rotation structure between the inner and outer tubular assemblies 14 and 16. For example, interengaging splines, designated generally at 210 in FIG. 8, may be provided on the outer surface of the upper end 92 of the lower mandrel 94 and the inside of the lower housing 52; this will allow axial movement but prevent rotational movement between the outer and inner tubular assemblies 14 and 16.

Having described the structure of the tool 10, its use and operation will now be explained. As shown in FIG. 13, the tool 10 typically is connected in series with other tools to form the bottom hole assembly. As used herein, "bottom hole assembly" (BHA) refers to the combination of tools supported on the end of the well conduit 12. As used herein, "drill string" refers to the column or string of drill pipe, coil tubing, wireline, or other well conduit 12 combined with attached bottom hole assembly 220, and is designated herein as 222. The BHA 220 may include a variety of tools including but not limited to a bit, a mud motor, hydraulic disconnect, jarring tools, back pressure valves, and connector tool. One example of a BHA 220, shown in FIG. 13, includes a coiled tubing connector 224, a dual back pressure valve 226, a jar 10, a hydraulic disconnect 228, and a fishing tool 230.

The tool 10 remains in a neutral position, shown best in FIG. 12, until a stuck tool or object in the well requires a jarring impact. It will now be appreciated that the structure of the instant jarring tool allows the operator to make an initial impact in either the up direction or the down direction. For illustrative purposes only, the procedure will be explained by starting with an up jar.

An up jarring action is initiated by pulling up on the outer tubular assembly 14, which is movable with the coiled tubing (not shown), relative to the inner tubular assembly 16, which is attached to the fish or other object downhole. As the coiled tubing is pulled up (towards the top of FIG. 12), the restricted section 132 is pulled up over the upper piston 136. This urges the upper piston 136 against the shoulder 180, blocking the flow ports 162 (FIG. 14). With the flow channel 150 through the piston 136 closed, resistance increases, and flow through the central flow passage 134 is substantially retarded but not completely blocked. Once the restricted section 132 clears the upper end 156 of the upper piston 136, full flow suddenly resumes, causing the up jar surface 202 to impact the up anvil surface 200 creating a jarring event.

After the up jar impact, the tool 10 may be recocked and jarred again in the up direction or in the down direction. That is, the tool 10 can be recocked and jarred repeatedly in one direction without jarring alternatively, in the opposite direction.

The tool is recocked after an up jar by pushing down on the drill string. This forces the restricted section 132 back down over the upper piston 136. The downward force of the restricted section 132 urges the piston 136 toward the end face 184 on the upper end 78 of the coupler mandrel 80. During this action, the flow channel 150 remains open, preventing the high resistance that occurs when the piston moves in the opposite direction. This allows the tool 10 to be returned to the neutral position without creating a jarring force. The tool 10 now may be jarred up or down from the neutral position.

To jar in the opposite or downward direction, the procedure is reversed. The drill string 22 is urged downward, forcing the restricted section 132 to move down over the lower piston 138. This urges the end 174 against the face 182 stopping the flow of fluid through the flow channel 142. Once the restricted section 132 clears the end 158 of the piston 138, the sudden resumption of flow causes the down hammer surface 200 to impact the down anvil surface 202 creating a downward jar. To recock the tool, the coiled tubing 12 is pulled upward to slide the restricted section 132 back up over the piston 138 into the neutral position. In this movement, the end 152 of the piston 138 is urged up against the face 186. Resistance in this direction is low due to the flow through the flow channel 142.

Now it will be understood that the several factors affect the speed of the jarring action. These factors include the clearances between the components of the jarring assembly, the length of the pistons, and the viscosity of the hydraulic fluid. The user can control the operation of the tool by selectively manipulating these variables. For example, the speed of the jarring action can be increased by using a less viscous fluid. The process of pushing down on coiled tubing has been described as similar to "pushing rope." Because of the tendency of the coiled tubing to bend, the downward pressure that can be exerted on a jarring tool is limited; the tool needs to be easy to recock in that direction. For this reason, it is desirable to make the lower piston shorter than the upper piston.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts, within the principles of the invention to the full extent indicated by the broad meaning of the terms. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A jarring tool attachable to a well conduit for delivering an impact downhole, the tool comprising:

an outer tubular assembly;

an inner tubular assembly telescopically received in the outer tubular assembly for relative movement from a neutral position to an up jar position and from the neutral position to a down jar position;

wherein one of the inner and outer tubular assemblies is attachable to the well conduit and the other of the inner and outer tubular assemblies is attached to a stationary object downhole;

wherein the inner and outer tubular assemblies are configured to form a sealed annular hydraulic chamber therebetween;

up and down anvil and hammer surfaces formed on the inner and outer tubular assemblies;

a restricted section formed in the hydraulic chamber dividing the hydraulic chamber into upper and a lower chambers;

a first piston supported in the hydraulic chamber for relative movement from a neutral position in the upper chamber above the restricted section to a jarring position below the restricted section, wherein the first piston comprises a flow channel continuous with the hydraulic chamber that permits fluid flow through the piston;

a first valve configured to close the flow channel in the first piston as the first piston moves relatively in a down direction through the restricted section and to open the flow channel in the first piston as the first piston moves relatively in an up direction through the restricted section, whereby a jarring impact is created as the first piston moves past the restricted section in the down direction;

a second piston supported in the hydraulic chamber for relative movement from a neutral position in the lower chamber below the restricted section to a jarring position above the restricted section, wherein the second piston comprises a flow channel continuous with the hydraulic chamber that permits fluid flow through the piston; and a second valve configured to close the flow channel in the second piston as the second piston moves relatively in an up direction through the restricted section and to open the flow channel in the second piston as the second piston moves relatively in a down direction through the restricted section, whereby a jarring impact is created as the second piston moves past the restricted section in the up direction.

2. The jarring tool of claim 1 wherein the outer assembly is attachable to the well conduit for movement therewith and wherein the inner assembly is attachable to the stationary object downhole.

3. The jarring tool of claim 2 wherein the outer assembly defines an inner wall that forms the outer wall of the hydraulic chamber and wherein the restricted section is on the inner wall of the outer assembly.

4. The jarring tool of claim 3 wherein the inner tubular assembly defines an outer wall that forms the inner wall of the hydraulic chamber and wherein the first and second pistons ride on the outer wall of the inner tubular assembly.

5. The jarring tool of claim 3 wherein the up and down hammer surfaces are on the outer tubular assembly and the up and down anvil surfaces are on the inner tubular assembly.

6. The jarring tool of claim 1 wherein the outer tubular assembly defines an inner wall that forms the outer wall of the hydraulic chamber and wherein the restricted section is on the inner wall of the outer assembly.

7. The jarring tool of claim 6 wherein the inner tubular assembly defines an outer wall that forms the inner wall of the hydraulic chamber and wherein the first and second pistons ride on the outer wall of the inner tubular assembly.

8. The jarring tool of claim 1 wherein the inner and outer tubular assemblies are configured to permit transmission of torque through the tool.

9. The jarring tool of claim 8 wherein the outer tubular assembly defines an inner wall, wherein the inner tubular assembly defines an outer wall, and wherein the tool comprises interengaging splines on the inner wall of the outer tubular assembly and the outer wall of the inner tubular assembly whereby relative axial movement between the inner and outer tubular assemblies is permitted but relative rotation between the inner and outer tubular assemblies if prevented.

10. The jarring tool of claim 1 wherein the outer tubular assembly and the inner tubular assembly define an elongate annular pressure equalization chamber, the pressure equalization chamber configured to allow the axial movement of the inner and outer tubular assemblies and being portable to the well so that well fluids can flow in and out of the pressure equalization chamber to balance the pressure in the hydraulic chamber.

11. The jarring tool of claim 1 wherein the first piston is longer than the second piston.

12. The jarring tool of claim 1 wherein each of the first and second pistons has an annular outer wall formed with a plurality of circumferential grooves therein.

13. The jarring tool of claim 1 wherein the flow channel in the first piston is ported through an upper end of the first piston, wherein the first valve comprises a first annular face supported in the hydraulic chamber, and wherein the first piston is slidably supported in the hydraulic chamber so that it is urged against the first annular face as the restricted section moves relatively upward over the first piston thereby closing the flow channel; wherein the flow channel in the second piston is ported through the lower end of the lower piston, wherein the second valve comprises a second annular face supported in the hydraulic chamber, and wherein the second piston is slidably supported in the hydraulic chamber so that it is urged against the second annular face as the restricted section moves relatively downward over the second piston thereby closing the flow channel.

14. The jarring tool of claim 13 further comprising a third annular face opposing the first annular face in the hydraulic chamber and a fourth annular face opposing the second annular face, wherein the first piston is supported for movement between the first and third annular faces, wherein the second piston is supported for movement between the second and fourth annular faces, wherein as the restricted section is forced relatively downward over the first piston, the first piston is urged into abutment with the third annular face, wherein the flow channel through the first piston and the third annular face are configured so that the flow channel remains open when the first piston abuts the third annular face, wherein as the restricted section is forced relatively upward over the second piston, the second piston is urged into abutment with the third annular face wherein the flow channel through the second piston and the fourth annular face are configured so that the flow channel in the second piston remains open with the second piston abuts the fourth annular face.

15. A bottom hole assembly comprising the jarring tool of claim 1.

16. A tool string comprising the bottom hole assembly of claim 15.

* * * * *